US005785016A

United States Patent [19]

Enderle et al.

[11] Patent Number: 5,785,016

[45] Date of Patent: Jul. 28, 1998

[54] ELECTROMAGNETIC OPERATING MECHANISM FOR GAS EXCHANGE VALVES OF INTERNAL COMBUSTION ENGINES

[75] Inventors: Christian Enderle, Baltmannsweiler; Jürgen Willand, Stuttgart; Paul Wurster, Neuhengstett, all of Germany

[73] Assignee: Daimler-Benz AG, Stuttgart, Germany

[21] Appl. No.: 844,499

[22] Filed: Apr. 18, 1997

[30] Foreign Application Priority Data

Apr. 19, 1996 [DE] Germany ..... 196 15 435.9

[51] Int. Cl.[6] ..... F01L 9/04

[52] U.S. Cl. ..... 123/90.11; 251/129.01; 251/129.16

[58] Field of Search ..... 123/90.11; 251/129.01, 251/129.02, 129.05, 129.07, 129.1, 129.15, 129.16

[56] References Cited

U.S. PATENT DOCUMENTS

| | | | |
|---|---|---|---|
| 4,715,332 | 12/1987 | Kreuter | 123/90.11 |
| 5,131,624 | 7/1992 | Kreuter et al. | 251/129.16 |
| 5,199,392 | 4/1993 | Kreuter et al. | 123/90.11 |
| 5,269,269 | 12/1993 | Kreuter | 123/90.11 |

FOREIGN PATENT DOCUMENTS

| | | |
|---|---|---|
| 0 328 194 | 8/1989 | European Pat. Off. . |
| 43 36 287 | 3/1995 | Germany . |
| 195 06 566 | 8/1996 | Germany . |

*Primary Examiner*—Weilun Lo
*Attorney, Agent, or Firm*—Klaus J. Bach

[57] ABSTRACT

In an electromagnetic operating mechanism for a gas exchange valve of an internal combustion engine wherein two control magnets are arranged in spaced relationship above the valve and an armature is axially movably disposed between the control magnets and and actuator rod extends from the armature through one of the control magnets to engage the valve, two compression springs are arranged outside the control magnets in opposition to one another, one engaging the valve so as to bias it toward a valve closing position and the other engaging the actuator rod so as to bias it into a valve opening direction and into engagement with the valve.

9 Claims, 1 Drawing Sheet

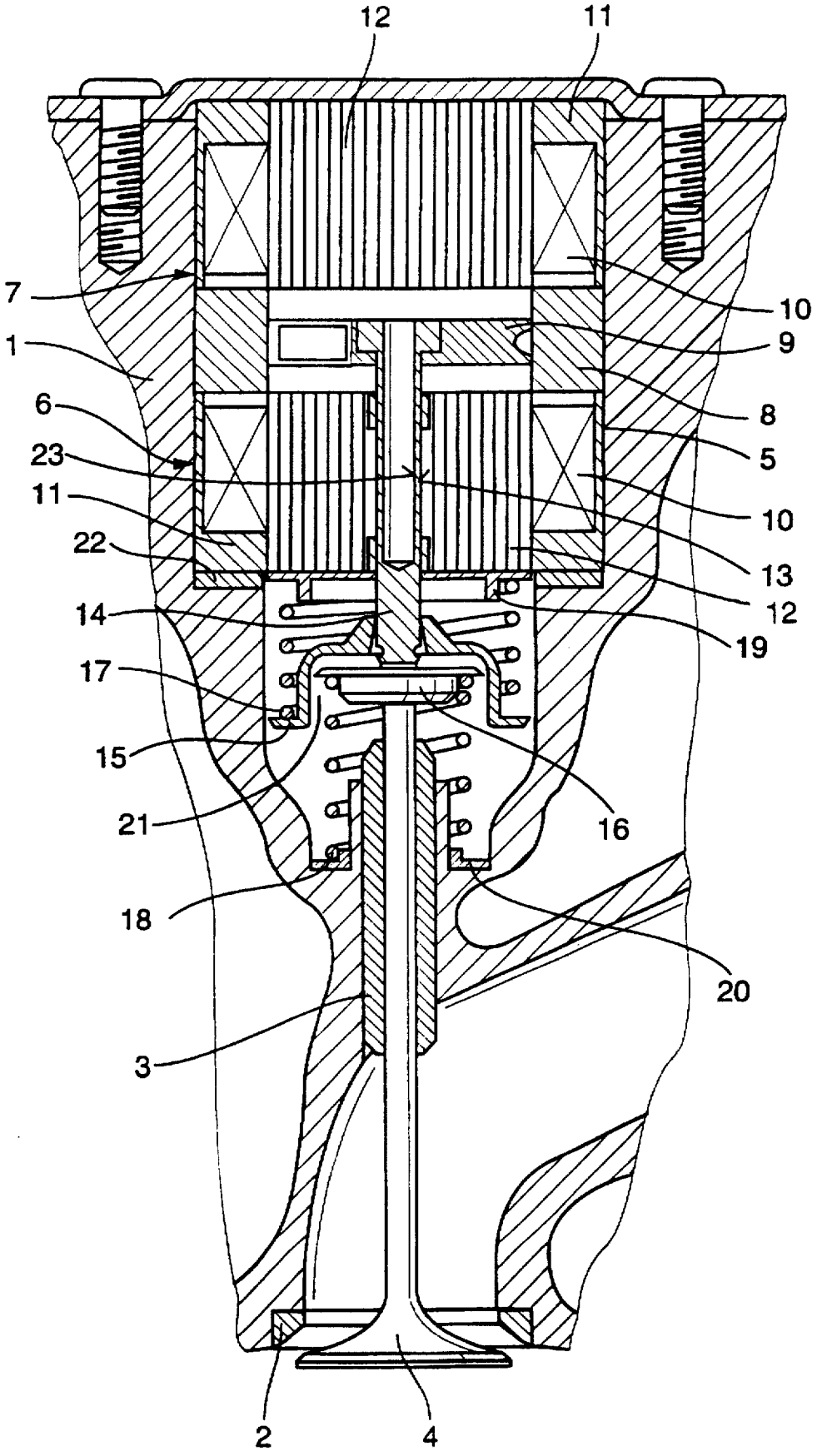
12
11
7
10
1
9
6
8
23
5
11
10
22
13
12
14
19
17
15
16
21
18
20
3
2
4

ELECTROMAGNETIC OPERATING MECHANISM FOR GAS EXCHANGE VALVES OF INTERNAL COMBUSTION ENGINES

BACKGROUND OF THE INVENTION

The present invention relates to an electromagnetic operated mechanism of gas exchange valves for internal combustion engines including oppositely acting compression springs biasing the valve to a center position and opposite magnetic means for actuating the valve and holding it in its open end closed positions.

DE 43 36 287 discloses a device for electromagnetically operating a gas exchange valve for internal combustion engines of motor vehicles. This device includes an armature which is attached to the gas exchange valve and two control magnets arranged on opposite sides of the armature for holding the gas exchange valve in an open position or in a closed position. Also one or more clamping elements. are provided which engage the control magnet responsible for holding the valve in the closed position in such a way that the control magnet can be re-adjusted for a length compensation for play-free activation of the valve drive when the valve is closed and the clamping engagement is released.

This known device insures that the armature always rests on the support surface or pole surface of the magnet body of the control magnet.

However, the solution known from DE 43 36 287 has the disadvantage that a hydraulic system with a complex control arrangement is necessary in order to ensure that the clamping engagement of the control magnet is always released at the correct time during the combustion cycle.

Furthermore, this known solution is disadvantageous insofar as the closing of the valve is not insured during idling because the combustion pressure may be inadequate. Therefore, during idling slight acceleration procedures must be performed, for which purpose the engine control has to be correspondingly modified.

It is the object of the present invention to provide a valve operating mechanism in which the aforesaid disadvantages of the prior art are avoided and length changes occuring in the valve drive during operation can be compensated with structurally simple means.

SUMMARY OF THE INVENTION

In an electromagnetic operating mechanism for a gas exchange valve of an internal combustion engine wherein two control magnets are arranged in spaced relationship above the valve and an armature is axially movably disposed between the control magnets and an actuator rod extends from the armature through one of the control magnets to engage the valve, two compression springs are arranged outside the control magnets in opposition to one another, one engaging the valve so as to bias it toward a valve closing position and the other engaging the actuator rod so as to bias it into a valve opening direction and into engagement with the valve.

With the arrangement according to the invention the gas exchange valves are closed securely and reliably closed without the need for additional control measures.

The simple and cost-effective arrangement of the compression springs outside, and on one side of, the control magnets is furthermore advantageous since the masses of the moving parts can be kept small. As a result, the actuation time of the armature which is dependent on the spring stiffness of the two compression springs and on the masses of the valve and its operating mechanism is very short. Consequently, a relatively long open time of the valve can be obtained.

As a result, large cylinders filling rates can be achieved even at high engine speeds resulting in a high engine performance.

Further advantages will become apparent from the following description of an exemplary embodiment of the invention on the basis of the accompanying drawing.

BRIEF DESCRIPTION OF THE DRAWINGS

The sole FIGURE is a longitudinal cross-sectional view of a valve operating arrangement according to the invention.

DETAILED DESCRIPTION OF AN EMBODIMENT THE INVENTION

With reference to the drawing, a device for electromagnetically operating a gas exchange valve of an internal combustion engine is illustrated. The device is basically of a well known design, for which reason only the essential parts are described below in greater detail.

A cylinder head 1 has a valve seat ring 2 and a valve guide 3 for guiding a valve 4. Arranged in an opening 5 of the cylinder head 1 are a lower control magnet 6 and, above it, an upper control magnet 7. The control magnets 6 and 7 are separated from one another by a guide ring 8 for guiding an armature consisting of an armature plate 9.

The lower control magnet 6 is provided for an open position and the upper control magnet 7 for a closed position of the valve 4. In a known manner, each of the control magnets 6, 7 has an inner coil 10 disposed in an outer magnetic housing 11 and a metal core 12. Both control magnets 6, 7 are fixed in the opening 5 in the cylinder head 1.

In order to permit the armature plate 9 to be displaced vertically, an actuator rod 14, which is permanently connected to the armature plate 9, is movably mounted in a guide hole 13 in the lower switching magnet 6. In order to reduce weight, the actuator rod 14 is hollow as shown at 23. A removable spring support plate 15 is provided at its end facing the valve 4, and a valve spring plate 16 is attached to the valve 4 by means of valve collets (not illustrated).

For a length compensation for play-free activation of the valve drive, a spring system with compression springs 17, 18 is arranged, coaxially with respect to the gas exchange valve 4, outside the control magnets 6, 7 on the side facing the valve 4. The compression springs 17, 18 are arranged in such a way that the compression spring 17 which is a valve opening spring is installed prestressed between an upper spring holder 19 arranged on the upper control magnet 6 and the spring plate 15 which is connected to the armature plate 9 via the actuator rod 14. On the other hand, the compression spring 18 which is a closing spring is mounted between a lower spring holder 20, disposed adjacent to the cylinder head casing 1, and the valve spring plate 16, which is firmly connected to the valve 4. In the exemplary embodiment shown in the figure, both the opening spring 17 and the closing spring 18 are helical springs.

The closing spring 18 exerts a force on the valve 4 in the closing direction, while the opening spring 17 is arranged in such a way that it exerts a force on the valve 4 in the opening direction.

The opening spring 17 and the closing spring 18 have characteristic spring curves which are approximately identical, i.e. they have similar properties regarding force, travel and spring constant, but are of different design with regard to their dimensions, wire diameters and winding diameters, such that they can be installed one extending into the other. For this purpose, the spring plate 15 for the opening spring 17 which constitutes the outer one of the compression springs 17, 18, has a recess 21 in which the valve spring plate 16 with the closing spring 18 is partially received.

By virtue of the fact that the compression springs 17, 18 are arranged at least partially within one another, the overall height of the device is kept very small and the guides for the movable parts can be of correspondingly short design, which advantageously results in low friction during spring-mass oscillations.

Furthermore, as a result of this structural arrangement, the control magnets 6, 7 are arranged sufficiently far from the combustion chamber that they are not excessively heated by the engine.

However, the compression springs 17, 18 may also be arranged coaxially one behind the other if for example a spring stiffness of such a magnitude is required that, for reasons of structural space, it appears inappropriate to insert one spring into the other.

Since the control magnets 6, 7 are arranged closely adjacent the valve 4, only a short actuator rod 14 is necessary which is firmly connected to the armature plate 9 by means of a compression connection. Such a short rod is subject to only a small differential length expansions whereby also the valve play is minimized.

The installation position of the control magnets 6, 7 is such that, in the deenergized state of the control magnets when the armature plate 9 is in the central position between the control magnets 6, 7, the opening spring 17 and the closing spring 18 are prestressed. The prestressing of the springs 17, 18 is selected such that the actuator rod 14 is always engaged with the shaft of the valve 4 by the armature plate 9 during movement between the control magnets 6, 7.

Furthermore, in order to permit adjustment of the armature plate 9 to a central position between the control magnets 6 and 7, a washer 22 is inserted into the opening 5 for receiving the switching magnets 6, 7 between the underside of the lower control magnet 6 and the cylinder head casing 1. The washer thickness is so selected that the temperature-dependent valve play is minimized.

The control magnets 6, 7 as illustrated in the drawing are rectangular in cross-section, which is particularly advantageous with regard to the requirement for a large magnetic force. The manufacturing expenditures and thus the manufacturing costs are lower than for example for pot-shaped switching magnets. Rectangular switching magnets are particularly suitable if the valve 4 to be activated is an exhaust valve, since an exhaust valve must be opened against a relatively high pressure in the combustion chamber.

For a more detailed explanation of the method of operation of the device illustrated in the drawing, it will now be assumed that the upper control magnet 7 is being energized. Then, the armature plate 9 together with the actuator rod 14 is pulled upwards and firmly engaged by the upper control magnet 7. As a result, the valve 4 is closed since the valve 4 follows the actuator rod 14 under the force of the closing spring 18, until the valve 4 is seated on the valve seat ring 2. During this vertical displacement process, the actuator rod 14 remains in contact with the valve 4. In the closed state of the valve 4, the opening spring 17 is compressed, while the closing spring 18 is expanded. However, the closing spring 18 is still subject to a degree of compression which, however, is less, by an order of magnitude, than that of the opening spring 17.

When the upper control magnet 7 is then deenergized the armature plate 9 with the actuator rod 14 and the valve 4 move downwards under the force of the opening spring 17. As a result, the valve 4 is disengaged from the valve seat ring 2 and opens. During this movement, as in every position of the armature plate 9, there is a play-free and firm engagement between the end of the actuator rod 14 facing the valve 4 and the end of the valve 4 facing the actuator rod 14.

In the open position of the valve 4, the armature plate 9 rests against the upper side of the lower control magnet 6, which is energized and holds the armature plate 9 in this position. Similar to the closed position of the valve 4, the closing spring 18 is now compressed in the open position of the valve while the opening spring 17 is expanded. The force relationship between the springs 17, 18 in the open position of the valve 4 is inverse to their force relationship in the closed position, since the characteristic curves of the two springs 17, 18 are similar.

After the lower control magnet 6 has been deenergized the armature plate 9 with the actuator rod 14 and the valve 4 move up again until the valve 4 is seated on the valve seat ring 2, and is thus closed. Also during this movement, the actuator rod 14 remains in contact with the valve 4.

What is claimed is:

1. An electromagnetic operating mechanism for a gas exchange valve of an internal combustion engine capable of moving said valve between open and closed positions, said mechanism comprising:

two control magnets arranged in spaced relationship from one another in axial alignment with said valve so as to form an armature space between said control magnets, an armature axially movably disposed in said armature space and having an actuator rod extending through one of said control magnets toward said valve, and axially aligned compression springs arranged in opposition to one another, one engaging said valve so as to bias it toward a valve closing position and the other engaging said actuator rod biasing it into engagement with said valve and toward a valve opening position, said springs extending around said valve and said actuator rod outside said one control magnet.

2. A mechanism according to claim 1, wherein one of said compression springs is larger in diameter than the other and said other compression spring is arranged at least partially within said one compression spring.

3. A mechanism according to claim 1, wherein said compression springs are arranged one axially behind the other.

4. A mechanism according to claim 1, wherein said compressssion spring biasing said valve in a closed position is mounted between a lower spring holder disposed adjacent to a cylinder casing and a valve spring support plate connected to the valve, and said spring biasing said valve into an open position is mounted between an upper spring holder which is arranged on said one control magnet and an actuator spring support plate connected to said actuator rod.

5. A mechanism according to claim 4, wherein said actuator spring support plate includes a central recess extending into said actuator spring, and said valve spring together with the end of said valve extend into said recess.

6. A mechanism according to claim 1, wherein a play-free and firm engagement between the end of said actuator rod which faces said valve and the end of the valve which faces said actuator rod is achieved in every position of said armature by means of said opposing compression springs.

7. A mechanism according to one of claim 1, wherein said compression springs have at least approximately identical characteristic spring curves.

8. A mechanism according to claim 1, wherein said control magnets are rectangular in cross-section.

9. A mechanism according to claim 1, wherein said one control magnet is supported on a washer whose thickness is so selected that said armature is disposed in a rest position which is in the center between said spaced control magnets.

* * * * *